United States Patent [19]

Maag

[11] Patent Number: 4,790,530

[45] Date of Patent: Dec. 13, 1988

[54] ARM FLEXION EXERCISE MACHINE

[76] Inventor: Henry Maag, 5332 Clark Cir., Westminster, Calif. 92683

[21] Appl. No.: 38,025

[22] Filed: Apr. 14, 1987

[51] Int. Cl.[4] ..... A63B 21/00

[52] U.S. Cl. ..... 272/134; 272/117

[58] Field of Search ..... 272/117, 118, 130, 134

[56] References Cited

U.S. PATENT DOCUMENTS

| | | | |
|---|---|---|---|
| 3,917,262 | 11/1975 | Salkeld | 272/134 |
| 4,239,210 | 12/1980 | Lambert, Jr. | 272/118 |
| 4,266,766 | 5/1981 | Calderone | 272/117 |
| 4,336,934 | 6/1982 | Hanagan et al. | 272/134 |
| 4,357,010 | 11/1982 | Telle | 272/117 |

*Primary Examiner*—V. Millin
*Assistant Examiner*—J. Welsh

[57] ABSTRACT

An arm flexion (arm curl) exercise machine which utilizes a frame-journaled rotating effort arm, which is mechanically linked to a frame-journaled rotating weight arm, which, together with the frame of the machine and the connecting link joining them, form a double-rocking-lever 4-bar linkage, which acts in conjunction wth the rotating weight arm to vary the resistive force applied to the operator's arm flexing muscles through body-machine contact with the rotating effort arm throughout the range of the exercise movement.

1 Claim, 4 Drawing Sheets

ARM FLEXION EXERCISE MACHINE

This invention relates to exercise equipment, in particular to an arm flexion (arm curl) exercise machine which utilizes a 4-bar linkage/rotating weight arm force-varying mechanism to apply a variably resistive force to an operator's arm flexing muscles throughout the range of the exercise movement.

BACKGROUND AND OBJECTIVE OF THE INVENTION

Present day arm flexion (arm curl) machines all work on the same primary principle of fixing the positions of the opertor's upper arms (humerus bones) while applying resistive forces to the operator's wrist joints through circular paths about the operator's elbow joints which tend to make the arms extend. The bicep muscles of the upper arms are developed as they oppose these forces by tending to make the arms flex during the exercise movement.

It is a well known fact and easily verified that due to joint mechanics, angles of pull of muscles, physiological make-up of muscles, etc. that in an arm curl movement the least amount of force can be generated in the fully contracted position and the most force can be generated just before 90° of arm flexion from the fully extended position. Consequently, a machine which varies the resistive force applied to correspond with the positionally related strength capabilities of the operator's bicep muscles will be more effective at developing these muscles.

The standard method of varying the resistive force applied on present day arm curl machines is through the use of cams used in conjunction with chains or cables, all of which have inherent problems. The problem with cams is that they are relatively hard to manufacture. The problem with cables is that, because of their relatively small cross sectional area, they carry very high tensile stresses (a ⅛" cable carrying 200 lbs, for example, has a tensile stress in it of approximately 16,300 psi). These already high stresses are multiplied and become cyclic (introducing fatigue wear) when a cable moves along bending over a small diameter pulley. These high cyclic stresses, applied to relatively small cross sectional areas, make cables stretch (eventually decreasing the machine's intended range of motion) and eventually fray and wear out (leading to replacement or catastropic failure). Chains, while not suffering the fatigue wear that cables do, are subject to stretching at their many joints (thus decreasing the machine's intended range of motion). They, also like cables, are subject to relatively high tensile stresses and in addition are noisy and introduce spurious drag to the machine.

In view of the advantages of applying a variably resistive force to an operator's arm flexing muscles in an arm flexion (arm curl) exercise movement, and the disadvantages of obtaining such a force through the use of cams, chains, or cables it is the objective of the disclosed invention to introduce an arm flexion (arm curl) exercise machine which applies a variably resistive force to an operator's arm flexing muscles through the use of a force-varying mechanism which uses only rigid members and pinned joints, thereby eliminating the problem associated with force-varying mechanisms using cams, chains, or cables.

SUMMARY OF THE INVENTION

The disclosed invention consist of a stable frame which includes provision for supporting an operator in a seated position with the positions of his upper arms fixed. Journaled in this frame, on an axis which is both approximately common with the axes through the operator's elbow joints and approximately parallel with the ground plane, is a rotating effort arm which includes body-machine force-transmitting contact surfaces at its distal end which engage the operator's hands and apply resistive force from the rotating effort arm to the operator's wrist joints through circular paths about the operator's elbow joints throughout the range of the exercise movement. Also journaled in the machine's frame on an axis which is both parallel with and offset by a specific distance from the axis of rotation of the rotating effort arm, is a rotating weight arm which, as its name indicates, contains provision for loading weights onto at a point offset from its axis of rotation. The rotating effort arm and the rotating weight arm are mechanically linked to each other at axes which are both parallel with and offset by specific distances from their respective axes of rotation by a rigid connecting link which also has a specific length between its centers of connection. These two rotating assemblies, the link joining them, and the frame of the machine join together to form a double-rocking-lever 4-bar linkage which acts in conjunction with the rotating weight arm to vary the resistive force applied to the operator's wrist joints through body-machine contact between the operator's hands and the rotating effort arm throughout the arm flexion exercise movement. Through a simple kinematic analysis, the specific lengths and orientations of the moving parts which constitute the 4-bar linkage/rotating weight arm force-varying mechanism can be specified to apply a load, at the hand-engaging contact surfaces on the rotating effort arm, which varies in accordance with the normal strength-to-position force applying capabilities of the average operator in the arm flexion exercise movement.

This invention, through the use of a 4-bar linkage/-rotating weight arm force-varying mechanism which uses only rigid members and pinned joints, applies a variably resistive force to an operator's arm flexing muscles throughout the range of the exercise movement without the use of cams, chains, or cables, thereby fulfilling its objective.

DESCRIPTION OF THE PREFERRED EMBODIMENT

Figure 1:
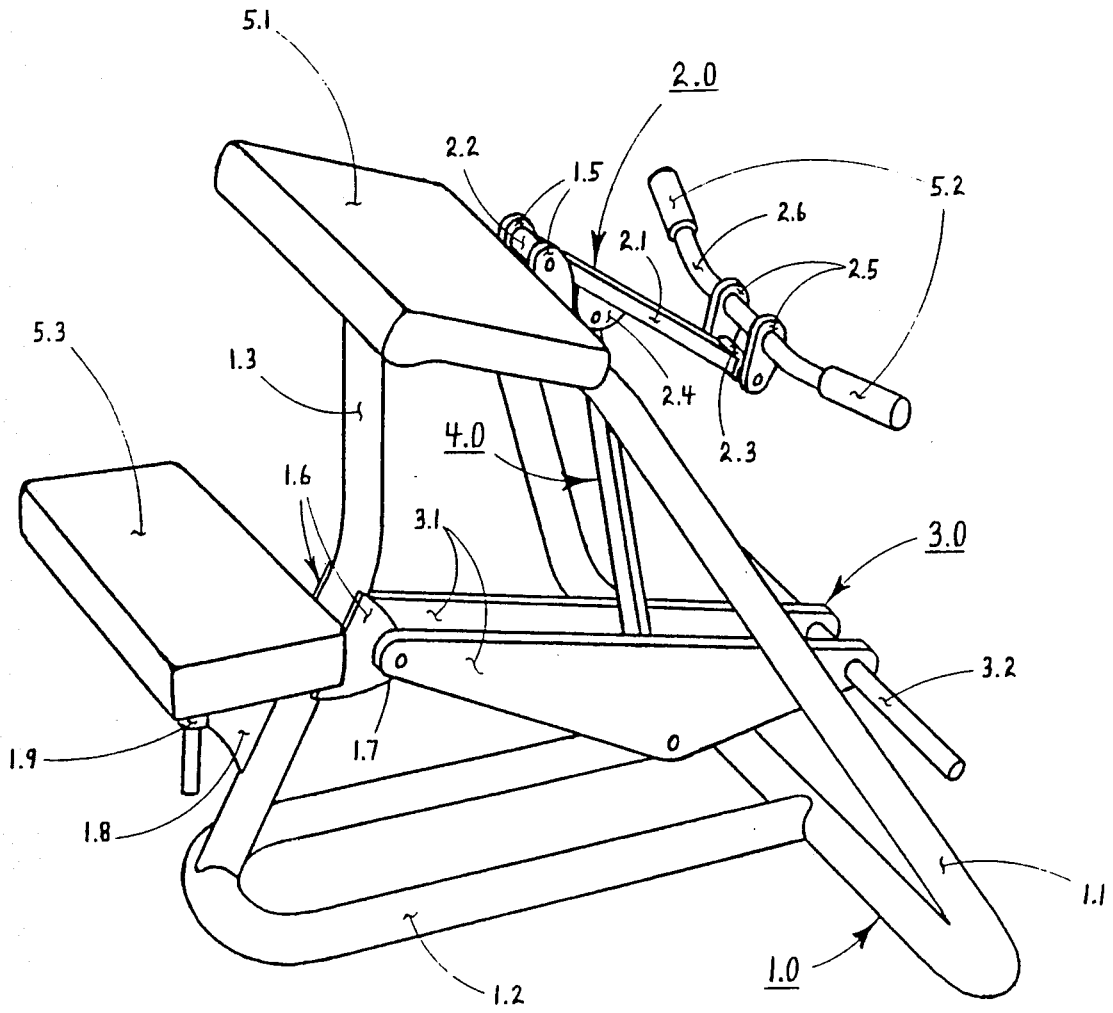
FIG. 1 is a pictorial view of the preferred configuration embodiment of the disclosed arm flexion machine with all parts labeled.
Figure 2:
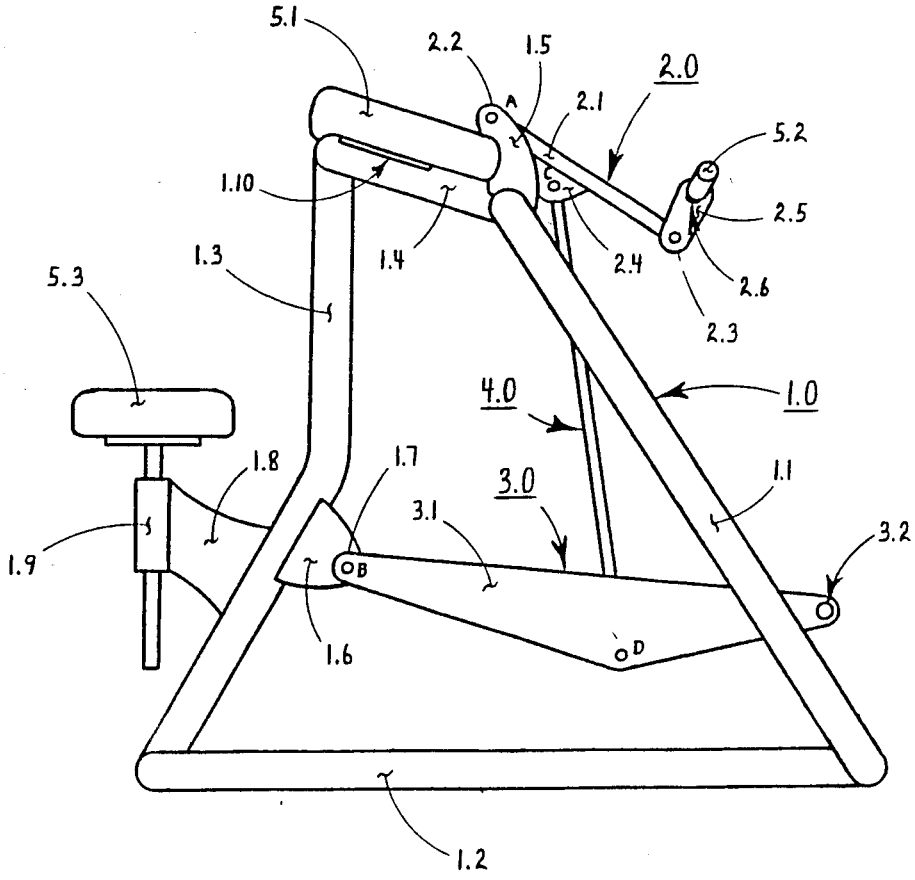
FIG. 2 is a side (plan) view of the preferred configuration embodiment of the disclosed arm flexion machine with all parts labeled.

Refer now to FIGS. 1 and 2 which show corresponding pictorial and side views of the preferred configuration embodiment of the disclosed invention. In general the frame of the machine is constructed primarily of round steel tubing which is welded together at the junctions where the tubes meet as shown. Welded to this tubular steel frame are steel flanges for journaling the bearings for the moving parts and steel tabs for attaching padded body-machine contact surfaces. The machine's moving parts are primarily constructed of rectangular steel tubing, solid round steel bar, and flat steel plate.

Refer now in detail to FIGS. 1 and 2 which show corresponding pictorial and side views of the preferred configuration embodiment of the disclosed invention. The primary frame of this configuration of the invention (assembly 1.0) consist of one closed round steel tubing loop, two "U" shaped steel tubes, and one round steel tube with a bend in it. The first round steel tubing loop (part 1.1) forms a closed trapezoidally shaped loop which is both symmetrical about the machine's plane of symmetry and lies in a plane which is perpendicular to the machine's plane of symmetry at about a 60° angle to the ground (as shown in the side view—FIG. 2). The next round steel tubing loop (part 1.2), which lies on the ground plane and is symmetrical about the machine's plane of symmetry, forms a "U" shaped half loop which joins into part 1.1 at its open ends where the planes which these two loops (parts 1.1 and 1.2) lie in intersect. The next round steel tubing loop (part 1.4) forms a short "U" shaped half loop which is both symmetrical about the machine's plane of symmetry and lies in a plane which is both perpendicular to the machine's plane of symmetry and which passes through the short straight section at the upper rearward end of part 1.1 at about a 20° angle to the ground plane. This short "U" shaped half loop (part 1.4) joins into part 1.1 at is open ends where the planes which these two loops (parts 1.1 and 1.4) lie in intersect. The fourth and last round steel tube (part 1.3) contains a 30° bend at approximately its midpoint. It lies on the machine's plane of symmetry and joins into the center of the "U" bend in part 1.2 at its lower end and joins into the center of the "U" bend in part 1.4 at its upper end as shown in FIGS. 1 and 2. These four steel tubes join together to form a simple, stable frame for this configuration of the invention when welded together as shown and described.

Centered on the machine's plane of symmetry and mounted to frame attached steel tabs (parts 1.10), which are welded to the sides of part 1.4 as shown, is an operator upper arm support and constraint pad (part 5.1) which engages the back sides of the operator's upper arms while in the operating position and serves the function of fixing the positions of the operator's upper arms while performing the exercise. Also centered about the machine's plane of symmetry and mounted to a screw type adjustable mount (part 1.9) which is anchored to part 1.3 of the machines frames by a steel flange (part 1.8), is an operator seat support pad (part 5.3) which engages the operator's seat and serves the function of supporting the operator's bodyweight while in the seated operating position.

Centered about the machine's plane of symmetry is a rotating effort arm assembly (assembly 2.0) which rotates about an axis (axis A) which is both parallel with the ground plane and positioned to be approximately common with the axis through the operator's elbow joints while in the operating position. This rotating effort arm assembly is mounted to a steel pin which is centered on axis A in frame attached flanges (parts 1.5) which are located on the top side of the short straight section at the upper rearward end of the trapezoidally shaped round steel tubing loop (part 1.1) in a position between the operator's elbow joints while in the operating position.

Figure 3:
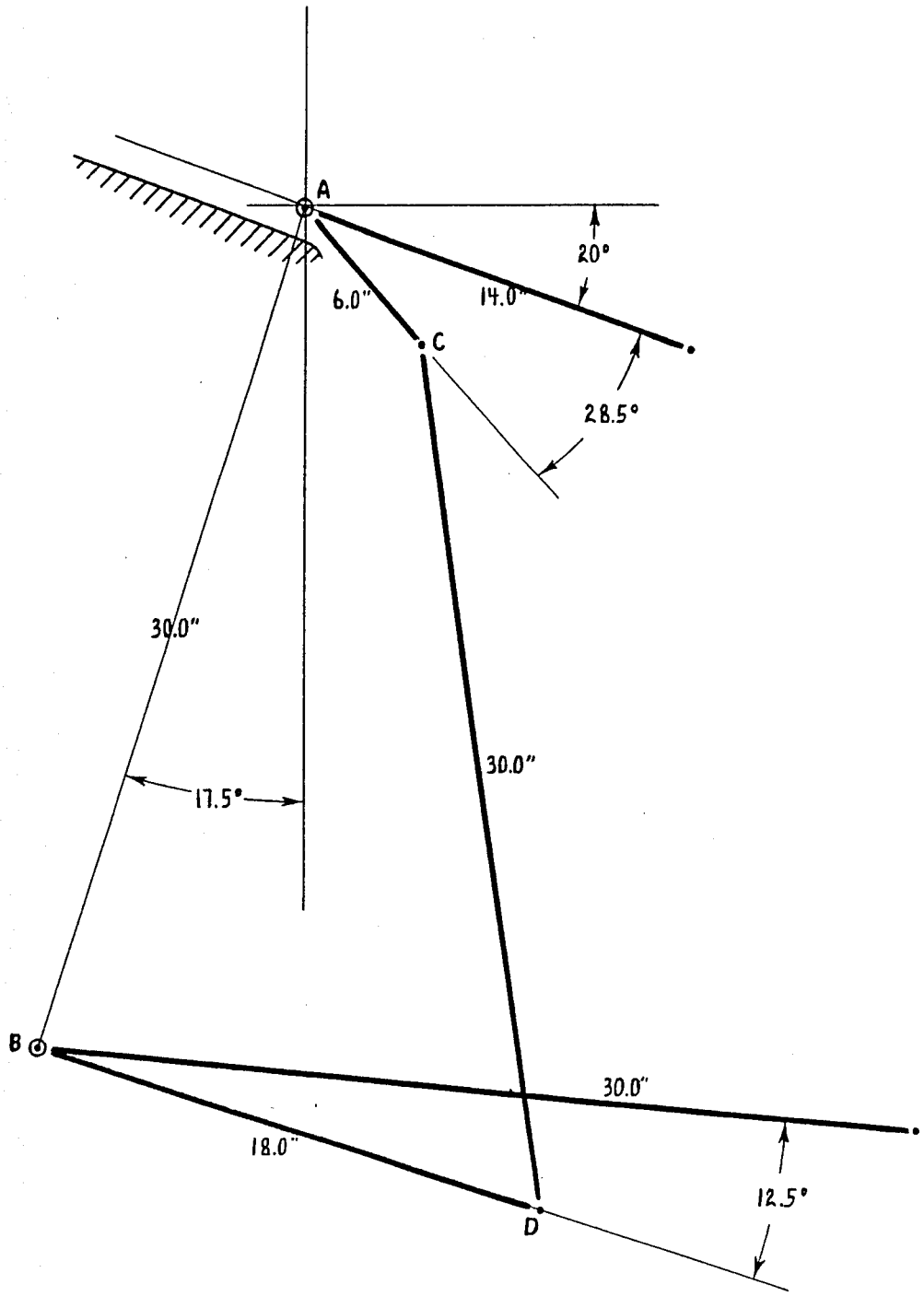
FIG. 3 is a kinematic view of the moving parts of the preferred configuration embodiment of the disclosed arm flexion machine showing all critical dimensions and angles.

The rotating effort arm assembly (assembly 2.0) is symmetrical about the machine's plane of symmetry which is perpendicular to its axis of rotation. As shown in FIGS. 1 and 2, it is composed primarily of a rectangular steel tube (part 2.1) which lies on the machine's plane of symmetry. Transversely attached to the proximal end of this rectangular steel tube (part 2.1) is a short transverse section of round steel tubing (part 2.2) which journals the bearings which engage the steel pin which mounts this assembly to the machine's frame at parts 1.5. Transversely attached to the distal end of this rectangular steel tube (part 2.1) and lying on a line which is both parallel with and separated from axis A by a distance of 14.0" as shown in FIG. 3 is another short transverse section of round steel tubing (part 2.3) which journals a second set of bearings which journal a steel pin which mounts the hand gripping assembly at the distal end of the rotating effort arm to the rotating effort arm. The hand gripping assembly is composed of a transversely mounted solid round steel gripping handle (part 2.6) which lies on a line which is parallel with the assembly's axis of rotation. This gripping handle part (2.6) is pivotly mounted to the distal end of the rotating effort arm by two parallel steel flanges (parts 2.5) which contain holes at their proximal ends which journal the steel pin which mounts the hand gripping assembly to the rotating effort arm. Attached to the outside ends of the solid round steel gripping handle (part 2.6) are two handgrips (parts 5.2—one on each side as shown) which engage the operator's hands while performing the exercise. Parallel to and offset from the assembly axis of rotation by a distance of 6.0" as shown in FIG. 3 is a second axis (axis C) which journals a second steel pin which is used in connecting a connecting link from the rotating effort arm assembly (assembly 2.0) to the rotating weight arm assembly (assembly 3.0) as shown in FIGS. 1 and 2. This second axid (axis C), which is offset from the assembly's axis of rotation, is centered in a pair of holes which are drilled in a pair of steel flanges (parts 2.4) which are welded to the bottom side of part 2.1 as shown in FIGS. 1 and 2. The angle formed between the line connecting the point of body-machine contact (where the operator's hands engage part 2.6) with the assembly's axis of rotation (axis A) and the line connecting axis C with the assembly's axis of rotation (axis A) is 28.5° as shown in FIG. 3.

As shown in FIGS. 1 and 2, this invention contains a rotating weight arm assembly (assembly 3.0) which rotates about an axis (axis B) which is parallel with the axis of rotation of the rotating effort arm assembly (assembly 2.0, axis A), separated from it by a specific distance, and placed so that the assembly and any weights mounted at its distal end will clear any obstructions throughout their range of motion. This rotating weight arm assembly is journaled in bearings which are centered on axis B in a short transverse section of round steel tubing (part 1.7) which is anchored to the machine's frame by frame attached flanges (parts 1.6) which are located on the forward side of the upright bent tube (part 1.3) in a position just below the bend as shown in FIGS. 1 and 2. The distance between the rotational axes of these two rotating assemblies (assemblies 2.0 and 3.0) is 30.0" and the direction to axis B from axis A is downward and rearward along a line which runs 17.5° off of the vertical line through axis A as shown in FIG. 3.

The rotating weight arm assembly (assembly 3.0) is symmetrical about the machine's plane of symmetry which is perpendicular to its axis of rotation. As shown in FIGS. 1 and 2, it is composed primarily of two parallel triangularly shaped steel plates (parts 3.1) which lie in planes which are both parallel with the machine's plane of symmetry and separated by enough distance to allow the connecting link which joins the rotating effort arm to the rotating weight arm to pass between them while performing the exercise. Transversely attached to the distal ends of these two parallel triangularly shaped steel plates (parts 3.1) and lying on a line which is both parallel with and separated from the assembly's axis of rotation (axis B) by a distance of 30.0" is a weight support bar (part 3.2) which extends outward approximately 12" to each side of the triangular steel plates (parts 3.1) as shown. This assembly (assembly 3.0) is mounted to its bearings, which are journaled in the short transverse section of round steel tubing (part 1.7) which is attached to the machine's frame, by a steel pin which is centered on the assembly's axis of rotation (axis B) and journaled through two holes which are drilled through the proximal ends of each of the two triangularly shaped steel plates (parts 3.1). Parallel to and offset from the assembly's axis of rotation by a distance of 18.0" is a second axis (axis D) which journals a second steel pin which is used in connecting a connecting link from the rotating effort arm assembly (assembly 2.0) to the rotating weight arm assembly (assembly 3.0) as shown in FIGS. 1 and 2. This second axis (axis D), which is offset from the assembly's axis of rotation, is centered in a pair of holes which are drilled in parts 3.1 as shown in FIGS. 1 and 2. The angle formed between the line connecting the axis of the assembly's weight support bar with the assembly's axis of rotation (axis B) and the line connecting axis D with the assembly's axis of rotation (axis B) is 12.5° as shown in FIG. 3.

As shown in FIGS. 1 and 2, the two rotating assemblies on this machine (assemblies 2.0 and 3.0) are mechanically linked to each other by a rigid steel bar (part 4.0) which contains parallel bushings at its opposite ends. One end of this connecting link (part 4.0) connects by way of a steel pin, as mentioned earlier, to the rotating effort arm assemby (assembly 2.0) at axis C as shown in FIGS. 1 and 2. The opposite end of this connecting link (part 4.0) connects by way of another steel pin, as mentioned earlier, to the rotating weight arm assemby (assembly 3.0) at axis D as shown in FIGS. 1 and 2. The distance between the axes of the parallel bushings on this connecting link (part 4.0) is 30.0" as shown in FIG. 3.

Figure 4:
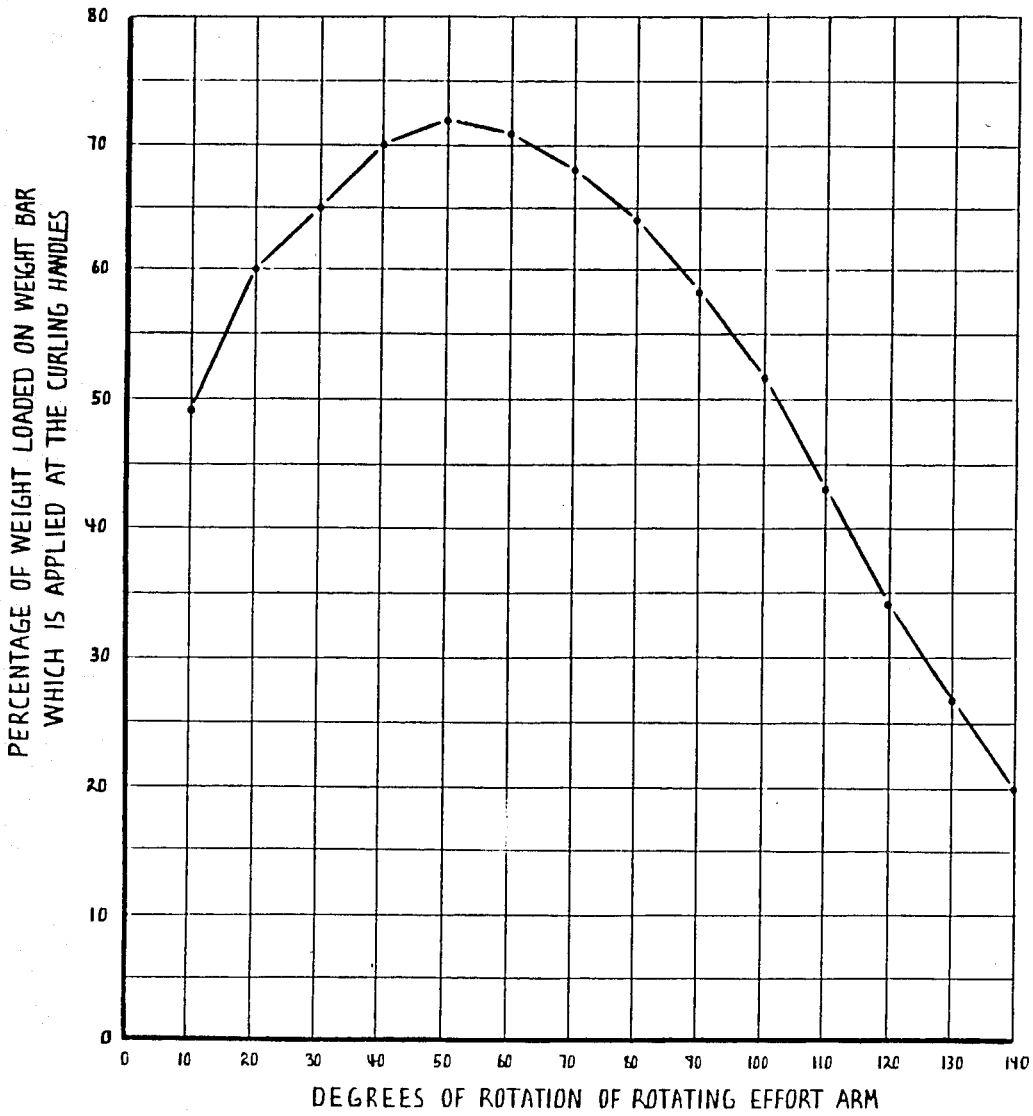
FIG. 4 is a graph generated from kinematic analysis of the force varying mechanism shown and described in FIG. 3.

When the rotating effort arm assembly (assembly 2.0) is in its starting position (which corresponds to the point where the line between the point of body-machine contact (where the operator's hands engage part 2.6) and the axis of rotation on the rotating effort arm assembly forms a 20° angle below the horizontal line through axis A) and all angles and distances for the force varying mechanism are as shown in FIG. 3 the corresponding output shown in the graph in FIG. 4 will be obtained while performing the exercise.

Centered on the machine's plane of symmetry and mounted to the rotating effort arm assembly at the lower part proximal end of part 2.1 in a position where it will engage the top side of the short straight section at the upper rearward end of part 1.1 is a rubber bumper (which is not visible in the views). This rubber bumper serves the function of supporting the machine's moving assembly and any weights loaded thereon in the starting position.

HOW THE INVENTION WORKS

As shown in FIGS. 1 and 2, this invention utilizes two rotating bodies which are journaled in a common frame and joined to each other by a rigid connecting body. These two rotating bodies (the rotating effort arm assembly—assembly 2.0 and the rotating weight arm assembly—assembly 3.0), the frame of the machine (assembly 1.0), and the rigid connecting body (the connecting link—part 4.0) join the form a 4-bar linkage. This 4-bar linkage as described in FIG. 3, when acting in conjunction with the sinusoidally changing values of force applied by the machine's rotating weight arm as the weights swing through a circular path through the gravitational field, yields the variably resistive force shown in the graph in FIG. 4 which closely corresponds to the strength-to-position capabilities of the normal operator in the arm flexion body movement. The actual variation in the resistive force which this machine applies is a function of a combination of the relative lengths and orientations of the rigid members forming the 4-bar linkage and the relative orientation of the rotating weight arm to the gravitational field.

CONCLUSION

This invention applies a resistive force to the operator's wrist joints through a circular path about his elbow joints which both varies as a function of the degrees of rotation of the operator's elbow joints and is correlated to the normal strength-to-position capabilities of the arm flexing muscles used in the arm flexion (arm curl) movement. The variably resistive force applied by this machine is obtained through the use of a 4-bar linkage acting in conjunction with a rotating weight arm. This 4-bar linkage/rotating weight arm force varying mechanism consist of only three moving parts connected to each other and to the frame of the machine at a total of four pivotal joints making the machine inherently more reliable, less noise, and more friction free than a comparable arm flexion machine which uses cams, chains, or cables. In addition, because the machine uses no members that go through any cyclic bending (as is the case with a machine using cables) the problems associated with fatigue wear are eliminated making the machine's moving parts essentially maintainence free.

I claim:

1. An exercise machine which develops an operator's arm flexing muscles through applying resistive forces to the operator's wrist joints which tend to make the wrist joints move through circular paths about the operator's elbow joints in the direction of arm extension, comprising:

a rigid frame which includes means for fixing the positions of said operator's upper arms on generally parallel lines which are generally perpendicular with the axis of rotation of said operator's elbow joints;

a rigid rotating effort arm which is journaled in said frame on a generally horizontal axis which is approximately common with the axes of rotation of said operator's elbow joints while said operator's upper arms are supported on said fixing means;

said rigid rotating effort arm including hand-engaging surfaces which, through body-machine contact, apply resistive forces to the operator's wrist joints through circular paths about the operator's elbow joints;

a rigid rotating weight arm which is journaled in said frame on an axis which is both parallel with and separated by a specific distance from the axis of rotation of said rigid rotating effort arm;

said rigid rotating weight arm includes means for loading weights onto at a point offset from its axis of rotiation;

said rigid rotating effort arm and said rigid rotating weight arm are mechanically linked to each other at axes which are both parallel with and offset by specific distances from their respective axes of rotation by a rigid connecting link which has a specific length between its centers of connection;

said rigid rotating effort arm, said rigid rotating weight arm, said link mechanically joining said rigid rotating effort arm and said rigid rotating weight arm, and said frame of said arm flexion exercise machine join together to form a 4-bar linkage which, when acting in conjunction with the sinusoidally changing values of force applied by the machine's rotating weight arm as the weights swing through a circular path through the gravitational field, applies a predetermined variably resistive force which varies as a function of the degrees of rotation of the operator's elbow joints and which is characteristic of the relationships in length and orientation of the four rigid members forming the 4-bar linkage and the orientation of the rotating weight arm to the gravitational field throughout the range of the exercise movement;

said specific distance between the axis of rotation of said rigid rotating effort arm and the axis of rotation of said rigid rotating weight arm, said specific distance between the axis of rotation of said rigid rotating effort arm and the axis of connection of said connecting link on said rigid rotating effort arm, said specific distance between the axis of rotation of said rigid rotating weight arm and the axis of connection of said connecting link on said rigid rotating weight arm, and said specific distance between the centers of connection on said connecting link all have a definite non-changing relationship to each other, which relationship, along with their orientations to each other, is determined through kinematic analysis of the moving parts of the 4-bar linkage/rotating weight arm force-varying mechanism and is dependent on said predetermined variably resistive force which said 4-bar linkage/rotating weight arm force-varying mechanism is designed to put out throughout the exercise movement.

* * * * *